United States Patent [19]

Romine et al.

[11] Patent Number: 4,607,899

[45] Date of Patent: Aug. 26, 1986

[54] SHUNT CONNECTOR AND METHOD OF FORMING

[75] Inventors: Edward L. Romine, Hoffman Estates; Roger W. Byczek, Westchester, both of Ill.

[73] Assignee: Bally Midway Mfg. Co., Franklin Park, Ill.

[21] Appl. No.: 615,138

[22] Filed: May 30, 1984

[51] Int. Cl.[4] ..... H01R 31/08

[52] U.S. Cl. ..... 339/19; 29/845

[58] Field of Search ..... 339/276 SF, 19, 217 S, 339/59 M, 46, 222, 206 P; 29/842, 845, 854

[56] References Cited

U.S. PATENT DOCUMENTS

| | | | |
|---|---|---|---|
| 3,594,714 | 7/1971 | Paullus et al. | 339/217 S X |
| 3,932,013 | 1/1976 | Yeager et al. | 339/217 S X |
| 3,963,302 | 6/1976 | Gourley | 339/217 S |
| 3,995,877 | 5/1976 | Cobaugh et al. | 339/276 SF X |
| 4,072,376 | 2/1978 | Shannon | 339/59 M X |

FOREIGN PATENT DOCUMENTS

| | | | |
|---|---|---|---|
| 1109331 | 4/1968 | United Kingdom | 339/276 SF |

*Primary Examiner*—Eugene F. Desmond
*Attorney, Agent, or Firm*—Todd S. Parkhurst

[57] ABSTRACT

A method of making conductors for shunt connectors including deforming a continuous strip of conductive material between lateral edges to form a plurality of electrical contacts integral at opposite ends with a pair of carrier strips. The spacing between electrical contacts is initially equal and the carrier strips are then deformed so that electrical contact assemblies having different spacings can be severed from the continuous strip with one of the carrier strips acting as a conductor between a pair of electrical contacts. The electrical contact assemblies are mounted on a non-conductive housings and locked therein by locking tabs with the housings being identical in configuration except for dimensions and having several gripping tabs formed thereon. The resultant shunt connector assemblies have center-to-center spacings between adjacent electrical contacts which are a predetermined dimension and multiples of that predetermined dimension to be capable of interconnecting pins having different spacings.

9 Claims, 6 Drawing Figures

10
12
14
20
20a
22
22a
24
26
80
82
84
86
100
120
122
124
126
128
C1
C2

SHUNT CONNECTOR AND METHOD OF FORMING

DESCRIPTION

TECHNICAL FIELD

The present invention relates generally to circuit boards and, more particularly, to connectors for interconnecting adjacent pins on a circuit board.

BACKGROUND PRIOR ART

In the electrical industry there are numerous applications which utilize modular components wherein numerous panels or printed circuit boards or the like are employed. For example, circuit boards are now used extensively for providing a modular component system wherein selected boards can easily be removed from the system and replaced with other boards in case of any type of malfunction.

One type of circuit board that has been used extensively consists of a base portion having a plurality of spaced pins thereon, all of which are connected to various electrical components at one end thereof, and which receive mating electrical contacts for connection of another component thereto. In the formation of this type of circuit board, the spacing between adjacent pins is normally quite small and has become somewhat standardized in the industry. For example, many types of circuit boards incorporating the spaced pin concept have a common center-to-center spacing between adjacent pins on the order of 0.100 inches, while other circuit boards have a center-to-center spacing of, for example, 0.200 inches.

In various applications of circuit boards of this type, it many times becomes necessary or desirable to interconnect adjacent pairs of contacts for various purposes. Such interconnection is initially accomplished through the use of complicated DIP switches wherein a switching system is incorporated into the circuit board with various alternatives for interconnecting various contacts. After the intiial development of DIP switches, various other types of plug arrangements were developed for providing a short circuit between adjacent terminals or pins on a circuit board. For example, the Berg Division of E. I. DuPont has been marketing a jumper connector which replaces the conventional DIP switches at a reduced cost. Various other types of jumper or shunt-type connectors have been developed and are being marketed to replace the DIP switches.

It is, of course, well known that one of the cheapest methods of forming electrical contacts is the utilization of a continuous integral strip that is stamped and formed to simultaneously produce a plurality of electrical contacts. Again, a primary consideration in development of electrical contact systems is the initial cost of producing the components and the subsequent cost for assembly, both of which must be considered in the development of shunt connectors of the type under consideration.

SUMMARY OF THE INVENTION

According to the present invention, a novel method of forming electrical contacts for use in interconnecting adjacent pins on a terminal circuit board utilizes the continuous strip concept wherein contacts in adjacent pairs can easily be formed with varying dimensions to meet the various needs in a particular application consisting of various circuit boards in an overall system.

The shunt connector of the present invention is designed to be capable of being manufactured and assembled at a minimum cost, while still having the beneficial effects of low exertion force during initial insertion of the electrical contacts on the cooperating pins. Also, the electrical contacts for the shunt connectors can easily be mass produced from a thin strip of conductive material and are designed so that shunt connectors having spacings that are multiples of each other for different circuit boards can easily be manufactured on a single continuous strip.

More specifically, the method of the present invention contemplates the formation of a plurality of electrical contacts in a continuous strip of conductive material by stamping and forming the contacts from the continuous strip and arranging the contacts so that they can easily be separated in multiples of a predetermined dimension for use in interconnection of adjacent terminal pins on circuit boards having different predetermined center-to-center spacings between pins.

More specifically, the substantially continuous strip of conductive material has opposed lateral edges and selected portions of the strip are removed between the lateral edges to produce a pair of continuous carrier strips adjacent the lateral edges and a plurality of spaced multi-sided electrical contacts that are integral at opposite ends with the respective carrier strips. In the specific embodiment of the present invention, all of the electrical contacts are initially formed with an equal spacing between adjacent pairs of contacts and then the carrier strips between alternating pairs of contacts are deformed to reduce the spacing to a fraction of the spacing between adjacent contacts of the respective electrical pairs. Each of the electrical contacts is formed to produce a multi-sided configuration having a twin-beam arrangement which is configured to result in a low initial insertion force for a pin received into the socket that forms the contact.

In the specific embodiment, each electrical contact includes a base portion that is integral at both ends with the respective carrier strips and a pair of beams that extend substantially perpendicular to the base adjacent lateral edges with the beams integral with the base adjacent one carrier strip and being free of the base the remaining distance. The contact beams have opposed deformed portions defining opposed contact points for contact with a pin received therein.

Thus, the continuous strip having a plurality of contacts can initially be delivered to a point of assembly in continuously interconnected form and one of the carrier strips can then be removed, while all of the electrical contacts remain connected to a common carrier strip that ultimately becomes the conductor strip between adjacent electrical contacts in the final shunt connector assembly. The remaining carrier strip can then be selectively separated to produce a pair of electrical contacts having predetermined spacing and an alternate pair of electrical contacts having a spacing that is a multiple of the predetermined spacing.

The separated pairs of electrical contact assemblies having different spacings are received into non-conductive housings that are identical in configuration but are different dimensionally. Each non-conductive housing is generally rectangular in cross-section and has a pair of spaced elongated openings extending from one end which are interconnected at the opposite end of the housing by a single elongated opening. In the assembled condition, the pair of electrical contacts are located in the spaced elongated openings while an interconnecting conductive strip is located in the single elongated opening. Also, in the assembled condition, locking tabs on each electrical contact provide a secure interlock between the non-conductive housing and the electric contact assembly.

Thus, a single continuous strip of electrical contacts can easily be separated into electrical contact assemblies having different spacings between the pairs of electrical contacts with the use of different housings of electrical configuration.

The housings have severable gripping tabs that can be used for ease in initial installation and can then be removed to provide a compact circuit board. The assembled shunt connector may also include a snap-in cover that is received into the single large elongated opening to prevent foreign matter from being accumulated therein and also prevent insertion of conductor pins into the wrong end of the shunt connector.

BRIEF DESCRIPTION OF SEVERAL VIEWS OF DRAWINGS

DETAILED DESCRIPTION

Figures 1, 2, 3:
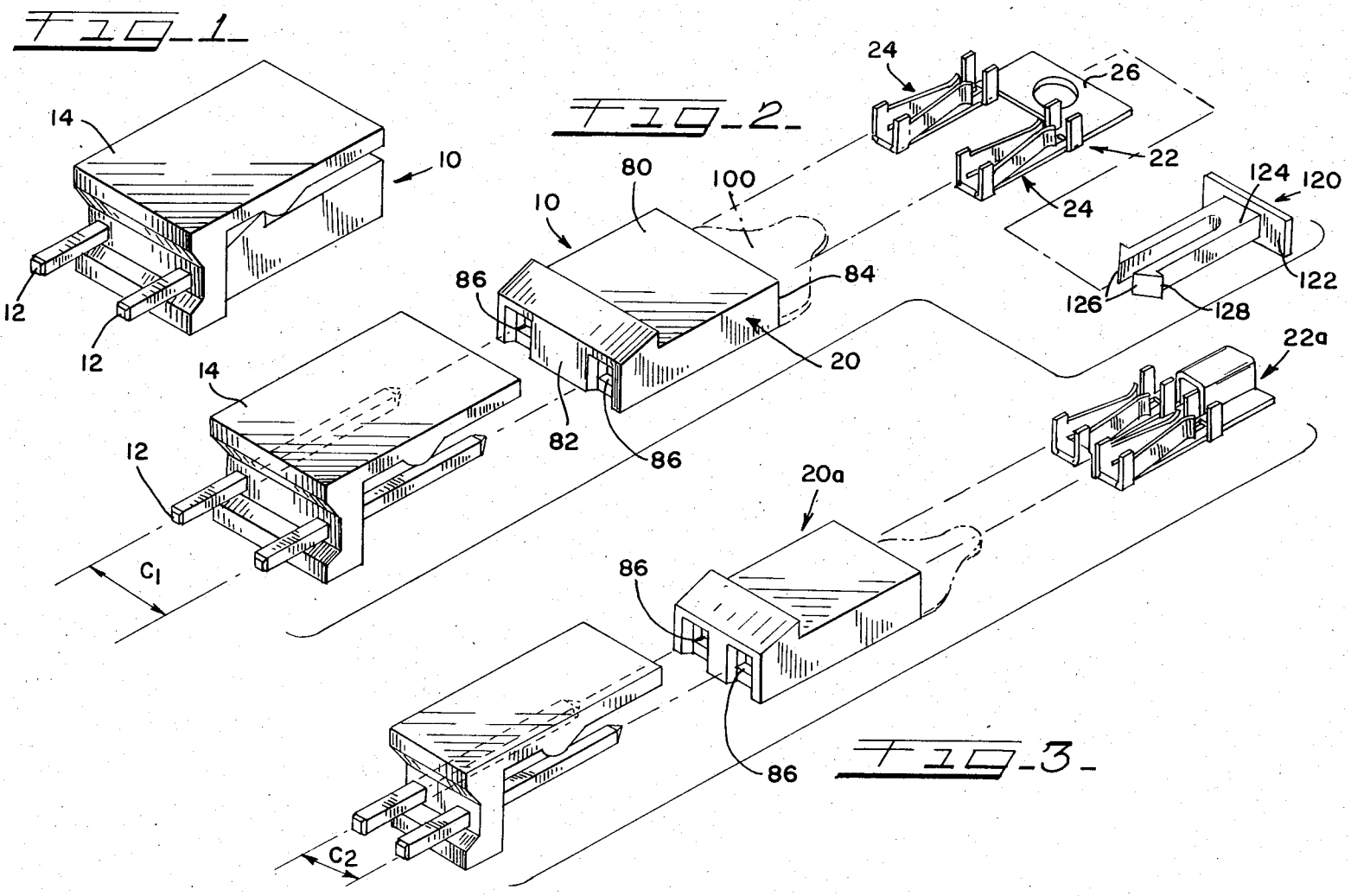
FIG. 1 is a perspective view of a shunt connector constructed in accordance with the present invention and inserted on a fragmentary portion of a circuit board.
FIG. 2 is an exploded view of the components shown in FIG. 1.
FIG. 3 is a view similar to FIG. 2 showing the second set of components forming part of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings shows a shunt connector generally designated by reference numeral 10 for interconnecting a pair of adjacent terminal pins 12 that are supported on a terminal board, generally designated by reference numeral 14. The terminal board 14 has illustratively been shown as included a small segment only having two spaced, adjacent pins 12, it being understood that any number, and usually several dozen of such spaced pins are assembled on a single board 14, all of which have a common center-to-center spacing.

As is well known in the circuit board industry, most manufacturers of circuit boards utilize a common center-to-center spacing and, in many instances, the center-to-center spacing between respective circuit boards are the same or are multiples of each other to provide a common dimension that has become somewhat standardized in the industry, although the multiples of a single dimension may vary. For example, one of the most common center-to-center spacings is 0.100 inches, while another common center-to-center spacing is 0.200 inches.

According to the present invention, the shunt connector 10 is produced in a fashion such that a single conductive strip can be configured to provide center-to-center spacings between pairs of electrical contacts which vary and which coincide with the more common spacings found on circuit boards.

The shunt connector assembly 10 generally consists of a non-conductive housing 20 and an electrical contact assembly, generally designated by reference numeral 22, consisting of a pair of electrical contacts 24 that are interconnected by a conductive strip 26.

Figure 6:
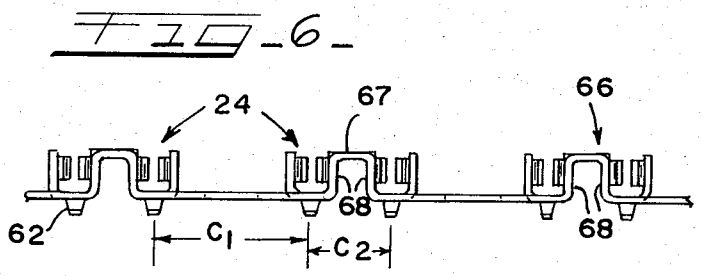
Figure 5:
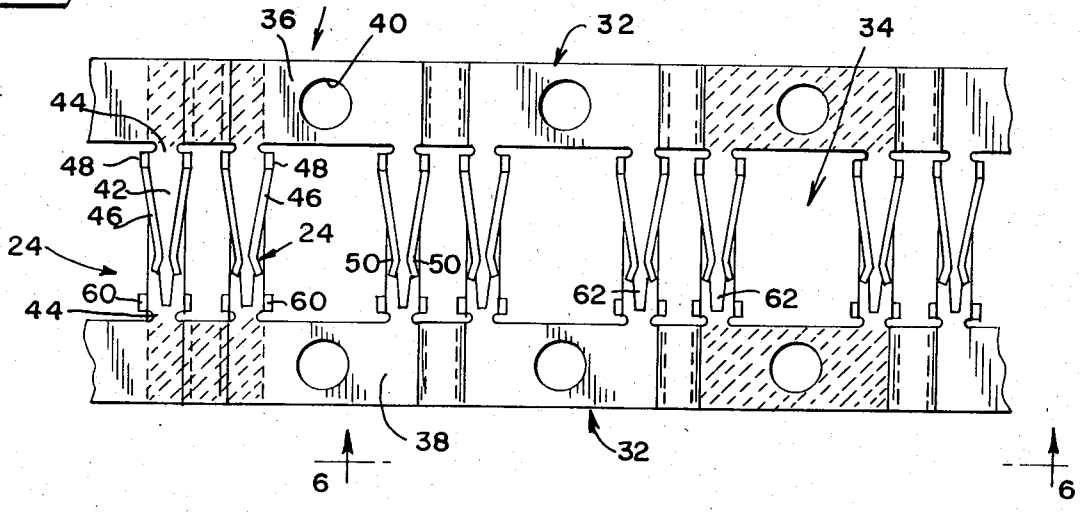
FIG. 5 is a plan view of a continuous conductor strip deformed in accordance with the present invention; and, FIG. 6 is an end view as viewed along line 6—6 of FIG. 5.

The most important aspect of the present invention can be more readily understood with particular reference initially to FIGS. 5 and 6, which show the formation of the contact assembly 22 from a continuous strip of electrically-conductive material. As illustrated in FIG. 5. A one-piece conductive strip 30 is initially a continuous strip of sheet metal between opposed lateral edges 32, which then has selected areas 34 removed therefrom to form a plurality of electrical contacts 24 that are interconnected at opposite ends by a pair of carrier strips 36 and 38. Each of the carrier strips 36 and 38 has positioning holes 40 formed therein for use in alignment in the formation process. Initially, all of the electrical contacts 24, which are deformed as will be described later, have a common spacing between the connecting portions of the contacts and the respective strips 36 and 38.

As illustrated in FIG. 5, each electrical contact 24 includes a base 42 that has an integral formation 44 at each end thereof to define a connection between the respective carrier strips 36 and 38 and the base 42 of each electrical contact 24. The electrical contact 24 has a pair of beams 46 that are each integral at one end with respective lateral edges of the base 42 through integral connections 48. These integral connections 48 extend substantially perpendicular to one side of the base 42 and the beams 46 are separated from the base through narrow spaces (not shown) in FIG. 5. Thus, each beam 46 is separated from the base throughout its length with the only connection being the integral connection 48 at one end thereof, and the respective beams define deflectable portions. Each of the beams 46 is deformed intermediate opposite ends thereof to define confronting contact points 50 which are spaced a substantial distance from the integral connections 48. These confronting contact points 50 on the respective beams of each electrical contact are aligned with each other and are spaced inwardly from the lateral edges of the base 42.

Each of the electrical contacts 24 also has a further pair of projections or legs 60 extending substantially perpendicular from lateral edges of the base 42 at the ends opposite the integral connections 48, for a purpose that will be described later.

Each electrical contact also has locking tabs deformed therefrom. As shown in FIG. 6, a locking means is deformed from base 42 and consists of a locking tab 62 that is integral at one end with the base 42 and has a locking ledge 64 at the opposite end. The locking tabs are aligned with the centers of the bases 42, more specifically the centers of the electrical contacts 24.

As indicated above, all of the integral formation 44 are initially equally spaced from each other along each of the carrier strips 36 and 38 by a dimension that is designated by reference numeral C1 in FIG. 6. This center-to-center dimension corresponds to a predetermined common center-to-center spacing for the pins 12, as will be described later. According to the primary aspect of the present invention, prior to, simultaneous with or after the formation of each of the electrical contacts 24, as described above, each of the carrier strips 36 and 38 is deformed between adjacent pairs of electrical contacts 24 to define a dimension C2 (FIG. 6) which is equal to a fraction of the dimension C1 so that the dimension C1 becomes a multiple of the dimension C2, for a purpose that will be described later.

In the illustrated embodiment, the deforming is preferably in the form of a corrugation which is generally U-shaped in cross-section, as shown by reference numeral 66 in FIG. 6. As shown therein, the U-shaped corrugation 66 has a base 67 that is located generally in a plane that extends across the free ends of legs 60 as well as the integral connections 48 while projecting supports 68 extend perpendicular and are integral with carrier 36 or 38, for a purpose that will be described later.

The housing assembly 20 which receives the electrical contact assemblies 22 discussed above is shown in detail in FIGS. 2 and 4. As illustrated in FIG. 2, the housing 20 consists of a generally rectangular non-conductive body 80 that has opposite ends 82 and 84. A pair of elongated transversely spaced, generally elongated openings 86 extend from end 82 towards the end 84. The elongated openings have a generally reduced portion 88 (FIG. 4) adjacent end 82 and an enlarged rectangular portion 90 extending from the reduced portion 88. The rectangular portions 90 of the respective openings 86 are interconnected adjacent the opposite end 84 of body 80 through a transverse elongated opening 92 that extends substantially the width of the internal portion of the body 80 to interconnect the rectangular portions 90 of the openings 86. The rectangular portions 90 and the transverse elongated opening 92 are dimensioned to receive the contact assembly 22 and securely retain the contact assembly therein.

Figure 4:
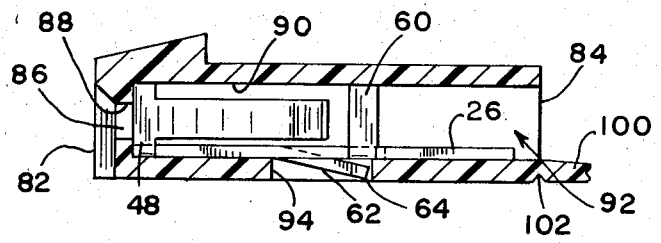
FIG. 4 is a cross-sectional view of the shunt connector constructed in accordance with the present invention.

Thus, as shown in FIGS. 2 and 4, the dimension of the integral connection 48 between the base 42 and the deflectable beams 46 is substantially equal to the height of the rectangular portions 90 and has a dimension common to the height of the supporting legs 60 that are located adjacent the opposite ends of the electrical contacts 24. Thus, the integral connections 48 and the legs 60 define a rigid support between the contact terminal assembly 22 and the non-conductive housing 20, in its assembled condition in FIG. 4.

As shown in FIG. 4, in the assembled condition, the conductive strip 26 of the contact assembly 22 is located within the enlarged transverse elongated opening 92 and defines the conducting connection between two adjacent terminal pins, respectively received into the electrical contacts 24. Also, in the assembled condition, the locking tabs 62 are received into the rectangular openings 94 formed in the non-conductive body 80 and the locking edges 64 engage an adjacent edge of the opening 94 to securely lock the contact assembly 22 within the conductive housing 20. Since each elongated electrical contact 24, which is interconnected by the conductor 26 that initially is part of the carrier strip 38, has a locking tab 62 aligned therewith, there are two transversely-spaced locking tabs 62 for each shunt connector assembly 10 to increase the resistant force in the event there are forces applied to the electrical contact that would tend to separate the contact assembly 22 from the non-conductive housing 20. The assembly shown in exploded view in FIG. 2 is configured for a shunt connector having a center-to-center spacing between openings 86 of about 0.200 inches.

The shunt connector assembly shown in FIG. 3 is substantially identical to that shown in FIG. 2 except that the center-to-center spacing C2 of openings 86 is one-half the spacing C1, i.e., 0.100 inches. In this version, a contact assembly **22*a* having two adjacent electrical contacts 24 interconnected by U-shaped corrugation 66 are separated from the continuous strip shown in FIG. 5 and inserted into the housing 20*a* and in the assembled position, the corrugation bridges the gap defined by opening 92** to further rigidify the assembly.

According to one aspect of the present invention, the shunt connector assembly 10 also has a grippable tab 100 that extends from one end thereof, such as the end 84, and is integral with an adjacent edge of the rectangular body 80. The grippable or finger tab 100 extends outwardly from the main body and is integrally joined thereto during the molding process by a reduced cross-section portion 102 (FIG. 4). Thus, the grippable tab 100 can be utilized for manipulation and insertion of the shunt connector 10 onto a pair of adjacent circuit board pins 12, which could be circular or rectangular depending upon the particular application, and after insertion thereon, the grippable tab can easily be severed from the remainder of the non-conductive housing 80 to provide an extremely compact circuit board assembly having adjacent pins electrically interconnected.

In the particular preferred embodiment of the invention illustrated in FIGS. 1, 2 and 3, the spacing between the pair of pins 12 forming part of the circuit board having center-to-center spacing which corresponds to the dimension C1 illustrated in FIG. 6. In FIG. 3, the same, virtually identical assembly is illustrated wherein the housing **20*a* is substantially identical in construction to housing 20, except that the center-to-center spacing between the respective openings 86 is equal to one-half of the center-to-center spacing of the housing 20 shown in FIG. 2. This particular housing configuration 20*a* is designed to receive a contact assembly 22*a* which is formed by severing the two adjacent electrical contacts 24 that are interconnected by the corrugated, or deformed, portion 66 and have center-to-center spacing, indicated by the dimension C2. This dimension C2 again corresponds to the center-to-center spacing C2 of the respective contact pins, illustrated in FIG. 3**, that form part of the circuit board.

In both versions of shunt connector, the enlarged opening 92 is preferably enclosed by a cover 120 to prevent debris and other foreign objects from accumulating therein and to prevent unintentional insertion of conductors therein that may destroy the circuit board. The cover 120 is generally T-shaped in outline and has a base 122 that generally corresponds to the configuration of opening 92 with a leg 124 extending therefrom. Leg 124 is bifurcated at the free end to produce two deflectable elements 126, each having an enlarged end that defines a locking ledge 128.

Thus, the cover can easily be snap-fitted into opening 92 and the locking ledge 128 received therein could lock onto the contact assemby or the housing. For example, in both embodiments, the cover could be configured so that the ledges could lock onto the inner edges of legs 60 or be configured to be received into recesses (not shown) in housing 20. In fact, in the version shown in FIG. 2, the cover could be configured to occupy the space above conductor 26 and act as an additional retainer for the contact assembly in housing 20. In the embodiment illustrated in FIG. 3, the base 122 could extend across the end of corrugation 66 and be locked to the housing 20. If desired, the cover could also be designed to latch directly onto the contact assembly.

In both versions of shunt connector disclosed herein, the housing 20 has what may be referred to as an "S"-lock with termimnal board 14. Thus, as shown in FIG. 1, housing 20 has a ramp extending from one wall thereof which cooperates with a ramp to interlock the shunt connector and the terminal board. Other types of locking means could also be used.

As can be appreciated from the above description, the present invention provides an extremely simplified, inexpensive method of manufacturing shunt connectors specifically designed for circuit boards having a common center-to-center spacing between pins.

We claim:

1. A method of making shunt connectors comprising the steps of forming a substantially continuous strip of conductive metal material having opposed lateral edges, removing selected portions of said strip in areas spaced from said opposed lateral edges to produce spaced carrier strips, forming the remaining of the conductive material to produce spaced multi-sided electrical contacts, deforming portions of the carrier strips to produce finished shunt connectors, each connector including a group of electrical contacts spaced from one another by a predetermined spacing, and adjacent electrical contacts of respective groups having a multiple of said predetermined spacing, thereafter separating one of said carrier strips from said electrical contacts, and permitting the other of said strips to remain attached to a plurality of contacts, so that the strip acts as a contact interconnector and can act as an electrical conductor, whereby contacts in a group can be separated from said other carrier strip to form a shunt connector with a predetermined spacing, and electrical contacts from adjacent groups can be separated from said other carrier strip to form a shunt connector having a multiple of said predetermined spacing.

2. The method as defined in claim 1, including the further step of producing non-conductive housings having transversely-spaced openings (1) spaced by said predetermined spacing; and, (2) a multiple of said predetermined spacing and inserting said shunt connectors into respective housings, and inserting a cover, having a bifurcated leg extending therefrom, into the housing behind the previously inserted shunt connector, the bifurcated leg having ledges for locking into the housing and thereby holding the cover securely in place, strengthening the retention of the contact assembly, preventing unintentional insertion of conductors, and preventing the accumulation of foreign objects in the housing.

3. The method as defined in claim 2, including the further step of forming a severable finger tab on each housing having a severable connection with the housing which can be easily severed after the shunt connectors have been mounted on a circuit board to separate the finger tabs from the housings.

4. The method as defined in claim 1, in which each electrical contact includes a base portion integral with the other of said carrier strips and a pair of beams extending substantially perpendicular to said base portion adjacent lateral edges and in which said beams are integral with said base portion adjacent the carrier strip with the remainder of said beams being free of said base and being directed inward and toward said other strip, and having intermediate opposed deformed portions defining opposed contact points with a contact pin.

5. A method as defined in claim 1, in which all of said electrical contacts initially have an approximately equal spacing between each other, including the further step of deforming said carrier strips between alternate pairs of electrical contacts so that the spacing between pairs of electrical contacts is a fraction of the spacing between adjacent contacts of the respective pairs of electrical contacts.

6. A method as defined in claim 1, including the further step of corrugating said carrier strips between alternate pairs of electrical contacts to reduce the spacing between alternate electrical contacts in said continous strip.

7. A shunt connector for interconnecting spaced conductive pins on a circuit board comprising a nonconductive housing having a pair of spaced openings extending from one end and an elongated opening extending from an opposite end and interconnecting said pair of spaced openings, an electrical conductor in said elongated opening providing electrical contact between a pair of spaced conductive pins received into said pair of spaced openings, said electrical conductor including a connecting strip adjacent an inlet to said elongated opening, a pair of electrical contacts integral with said connecting strip extending into said pair of spaced openings and respectively aligned therewith, each of said electrical contacts including an elongated, generally flat base portion integral at one end with said connecting strip and having an opposite end, a pair of contact beams extending substantially perpendicular from lateral edges of said base portion, each of said contact beams having an integral connection with a lateral edge adjacent said opposite end and a remaining deflectable portion, each of said deflectable portions being deformed intermediate opposite ends to define confronting contact points above said base portions so that insertion of said conductive pins through said spaced openings will deflect said contact beams and make electrical contact with said contact points, legs extending perpendicularly from opposing edges of the base opposite the integral connection end, the legs and the integral connections cooperating to proide a rigid support between the contact terminals, and a cover having a deflectable bifurcated leg with locking edges to close the nonconductive housing to prevent unintentional insertion of conductors.

8. A shunt connector as defined in claim 7, in which each generally flat base has a locking tab deformed therefrom adjacent said connecting strip and in which said housing has a pair of spaced locking openings receiving said locking tabs to provide multiple lock points between said housing and said electrical conductor.

9. A shunt connector as defined in claim 7, in which said housing has a grippable tab extending from said opposite end, said grippable tab having a severable connection with said housing to be removable from said housing after placement of said shunt connector on a pair of conductive pins.

* * * * *